US005588171A

United States Patent [19]

Hamann

[11] Patent Number: 5,588,171

[45] Date of Patent: Dec. 31, 1996

[54] DRAIN LINE CLEANING APPARATUS

[75] Inventor: James L. Hamann, Eldridge, Iowa

[73] Assignee: Pettibone Corporation, Lisle, Ill.

[21] Appl. No.: 410,478

[22] Filed: Mar. 24, 1995

[51] Int. Cl.[6] ..... B08B 9/00

[52] U.S. Cl. ..... 15/104.12; 15/104.09

[58] Field of Search ..... 15/104.12, 29, 15/104.09

[56] References Cited

U.S. PATENT DOCUMENTS

| | | | |
|---|---|---|---|
| 1,426,919 | 8/1922 | Sladden . | |
| 1,448,876 | 3/1923 | Sladden . | |
| 1,584,740 | 5/1926 | Denny . | |
| 2,218,130 | 10/1940 | Court | 15/104.12 |
| 2,710,980 | 6/1955 | Pletcher | 15/104.12 |
| 2,735,794 | 2/1956 | Pletcher . | |
| 2,932,836 | 4/1960 | Pletcher | 15/104.12 |
| 3,740,785 | 6/1973 | Latall . | |
| 3,813,133 | 5/1974 | Walter et al. . | |
| 3,872,533 | 4/1975 | Proffit . | |
| 4,206,313 | 6/1980 | Cavoretto . | |
| 4,516,286 | 5/1985 | Crane . | |
| 4,677,997 | 7/1987 | Strauss | 15/104.12 |
| 4,766,631 | 8/1988 | Crane et al. . | |
| 4,795,495 | 1/1989 | Dobson, Sr. . | |
| 4,819,314 | 4/1989 | Shaddock . | |
| 4,909,325 | 4/1990 | Hopmann . | |
| 4,985,763 | 1/1991 | Fraser . | |
| 5,035,519 | 7/1991 | Aizawa et al. . | |
| 5,042,616 | 8/1991 | McHugh . | |
| 5,090,079 | 2/1992 | Allison et al. . | |
| 5,098,205 | 3/1992 | Zehndbauer et al. . | |
| 5,179,753 | 1/1993 | Flaherty | 15/104.12 |
| 5,244,505 | 9/1993 | Allison et al. . | |
| 5,329,662 | 7/1994 | Salecker . | |
| 5,333,448 | 8/1994 | Salecker . | |
| 5,335,388 | 8/1994 | Salecker . | |
| 5,379,476 | 1/1995 | Salecker . | |

FOREIGN PATENT DOCUMENTS

| | | |
|---|---|---|
| 1239761 | 8/1988 | Canada . |
| 77562 | 4/1983 | European Pat. Off. . |
| 2432168 | 2/1976 | Germany . |
| 2906382 | 8/1980 | Germany . |
| 8501521A | 12/1986 | Netherlands . |
| 677807 | 6/1991 | Switzerland . |
| 419272 | 8/1974 | U.S.S.R. . |
| 578128 | 10/1977 | U.S.S.R. . |
| 647415 | 2/1979 | U.S.S.R. . |
| 795592 | 1/1981 | U.S.S.R. . |
| 921644 | 4/1982 | U.S.S.R. . |
| WO89/12513 | 12/1989 | WIPO . |
| WO91/13699 | 9/1991 | WIPO . |
| WO92/05888 | 4/1992 | WIPO . |

OTHER PUBLICATIONS

Brochure, "State–of–the–Art Drain Cleaners Designed for Breaking Through Tough Clogs", Mustang Units Co., 1993.

Advertisement, "Mustang Units Introduces: The Root Shredder™ and The Snagger Jet Heads".

Brochure excerpts regarding root cutters, Aquatech, Inc., pp. 5, 6, 8 and 9.

Sewer Rodding Equipment Co. Bulletin 3020, cover and pp. 47–50, 1991.

"The New Model 747–40004 'Sniper Rotator Jet*'", Sewer Equipment Company of America, Model WJ–49P Patriot root and grease cutter.

CON.TEC International Brochure.

Shamrock Pipe Tools, 1995–96 Catalog, pp. 19, 34. 35, 36 and 38.

"O'Brien Water Jet™ Root Cutter", brochure, 1987.

UEMSI Pipeline Maintenance Parts and Equipment brochure, 1994.

Brochure and price list, "Now, A New Root Cutter for Small Trailer Jets!", Spartan Tool Division, 1993.

*Primary Examiner*—David Scherbel
*Assistant Examiner*—Tony G. Soohoo
*Attorney, Agent, or Firm*—McDermott, Will & Emery

[57] ABSTRACT

A drain line cleaning apparatus is disclosed which includes a spin head, capable of high speed rotation. The spin head is attached to a spinner cap which carries a bit and one or more blade members which cut through roots and other residue deposited in drains. The spin head is powered by water jetted to notches formed on an inner surface of the spin head. The jetted water is also deflected by the notches to create thrust to force the drain line cleaning apparatus through the drain line.

9 Claims, 9 Drawing Sheets

FIG. 10
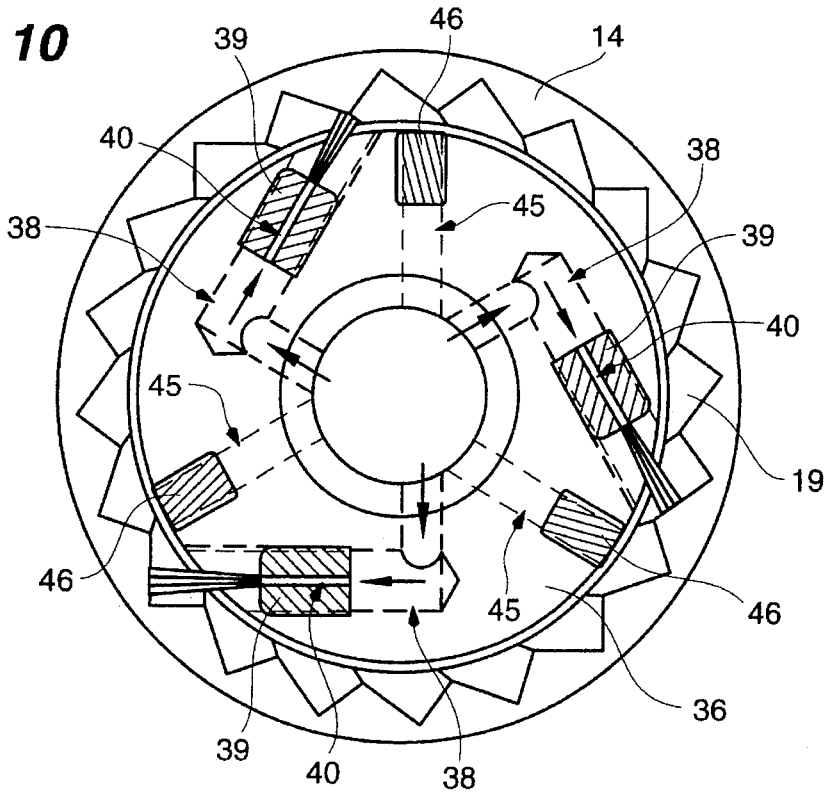
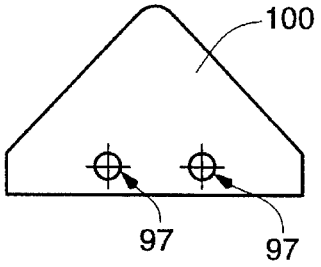
FIG. 11
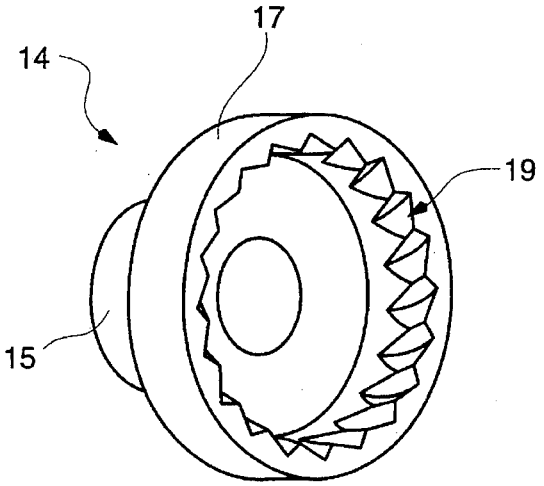
FIG. 12

DRAIN LINE CLEANING APPARATUS

FIELD OF THE INVENTION

This invention relates to devices for cleaning sewer and drain lines, and more particularly to such cleaning devices which utilize high-pressure water.

BACKGROUND OF THE INVENTION

The use of high-pressure water devices for clearing sewer and other drain lines of accumulated debris, roots, and other obstructions is known in the art. These devices typically utilize a high pressure jet head which employs multiple jet streams to perform cutting, cleaning and flushing functions. Many of these types of drain line cleaning devices are unable to efficiently clear fibrous debris such as root masses from a drain line. Consequently other drain line cleaning devices have been developed which utilize the hydraulic force of water pressure and flow to drive a high speed cutter which mechanically breaks down root masses and allows them to be flushed from the drain line. In one prior art device sold by Mustang Units Co. of Eldridge, Iowa under model number JH-SHRD, a spinner head capable of reaching 14,000 RPM carries a variety of whip or blade members. This device is powered by the reactionary force of a single spinner jet which generates a jet of water vectored tangent to the rotation of the spin head upon which it is mounted. In addition, a fan of spray vectored rearward acts to draw the system through a drain line. Water is also channeled to a thrust bearing for cooling and lubrication purposes. Cutter elements are mounted to the spin head to facilitate the mechanical cutting action of the device.

This type of prior art device employs a bearing/shaft design requiring a high level of precision machining and the matching of mating parts, making the device expensive to manufacture. In addition, the single spin jet is very inefficient in producing adequate torque on the cutter head.

SUMMARY OF THE INVENTION

The present invention eliminates the foregoing disadvantages in the art of drain line cleaning apparatus by providing a high-pressure water powered jet device for cleaning drain lines, sewer lines and the like. A spin head, capable of high speed rotation, is attached to a spinner cap which carries a bit and one or more blade members which cut through roots and other residue deposited in drains. The spin head is powered by water jetted to notches formed on an inner surface of the spin head. The jetted water is also deflected by the notches to create thrust to force the drain line cleaning apparatus through the drain line.

It is an object of the present invention to provide an efficient drain cleaning apparatus.

Another object of the invention is to provide a drain cleaning apparatus in which a cutting tool revolves at very high RPM.

A further object of the invention is to provide a drain cleaning apparatus having a revolving cutter of relatively low torque compared to gearhead reduced hydraulic motors used on prior art drain cleaning devices.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 10 shows nozzles of the present invention contained in jet passageways of a manifold;

FIG. 11 is a front elevational view of a bit of the present inventions, and;

FIG. 12 is a perspective view of the spin head of one embodiment of the invention.

DETAILED DESCRIPTION OF THE PREFERRED EMBODIMENTS

Figure 1A:
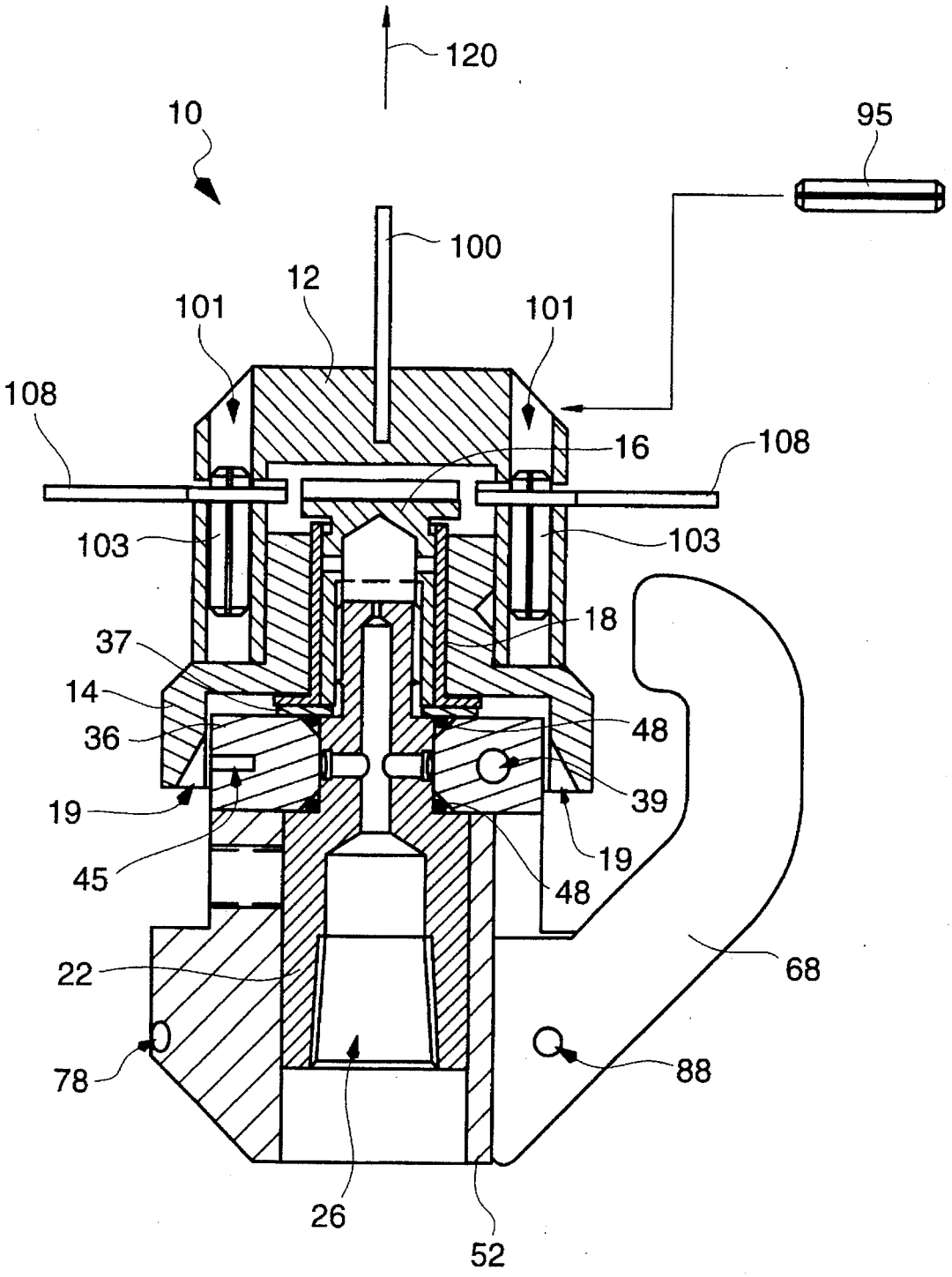
FIG. 1A is a front sectional view of one embodiment of the present invention.
Figure 1B:
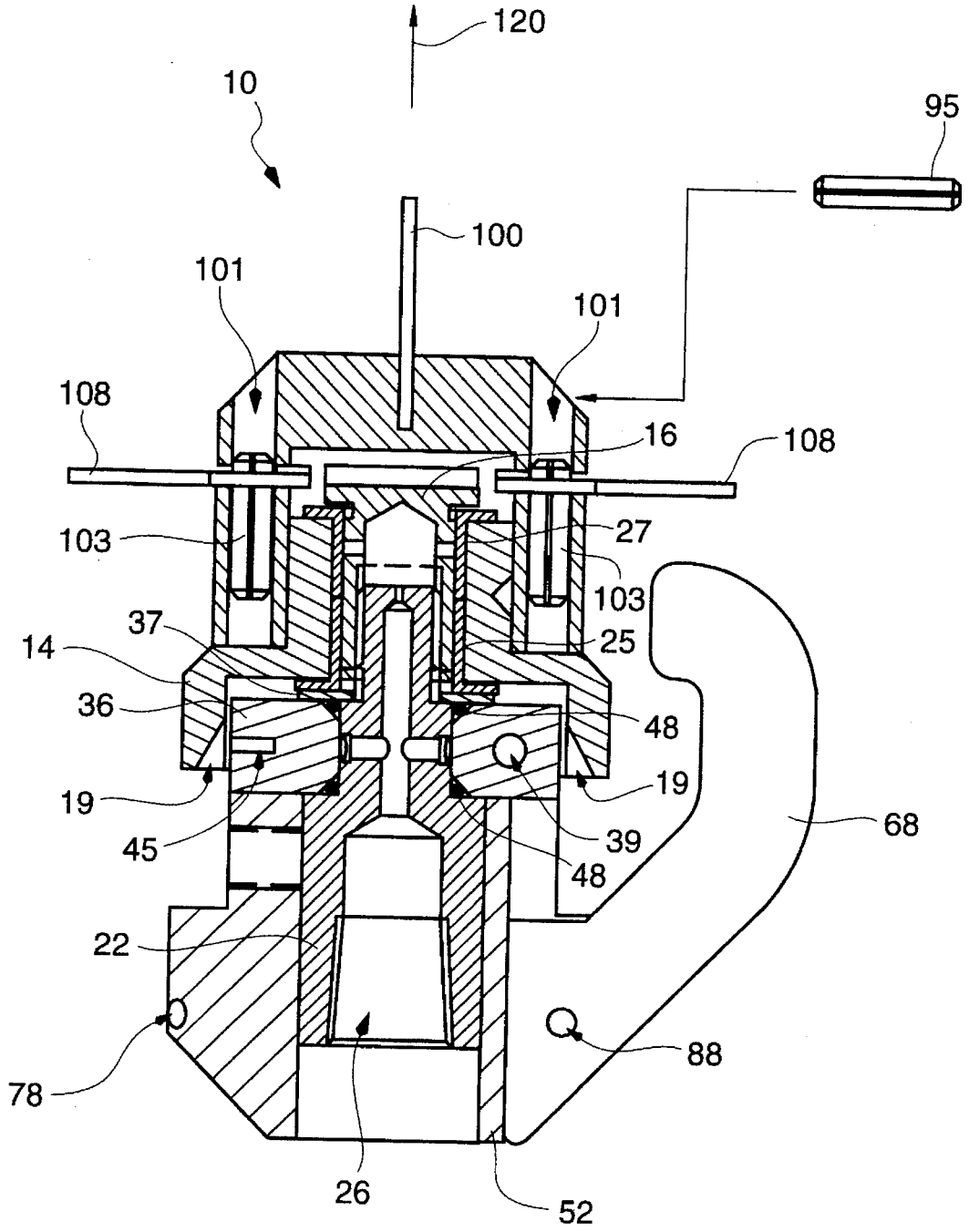
FIG. 1B is a front sectional view of a second embodiment of the present invention.
Figure 2:
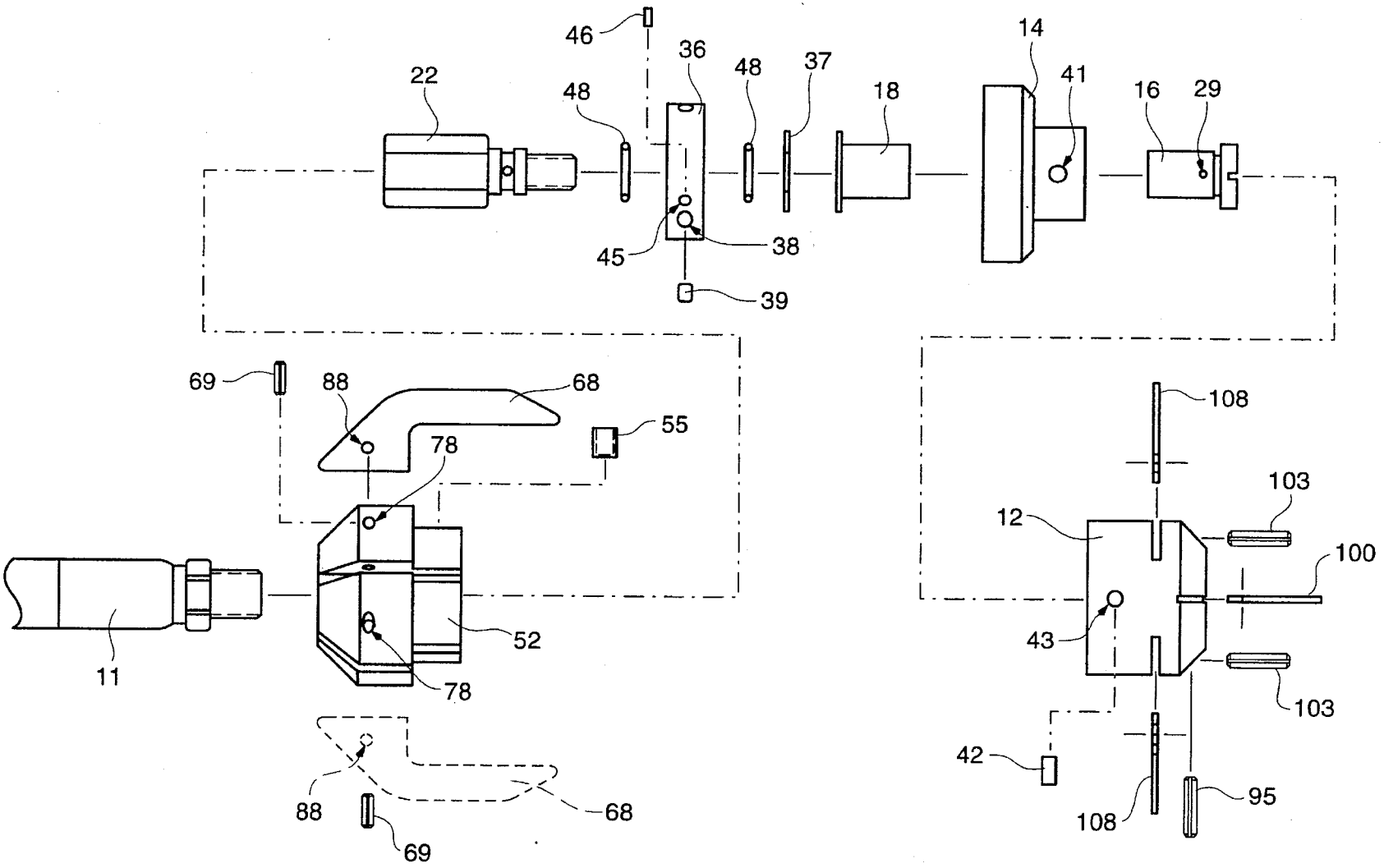
FIG. 2 is an exploded view of the embodiment of the present invention shown in FIG. 1A.
Figure 3:
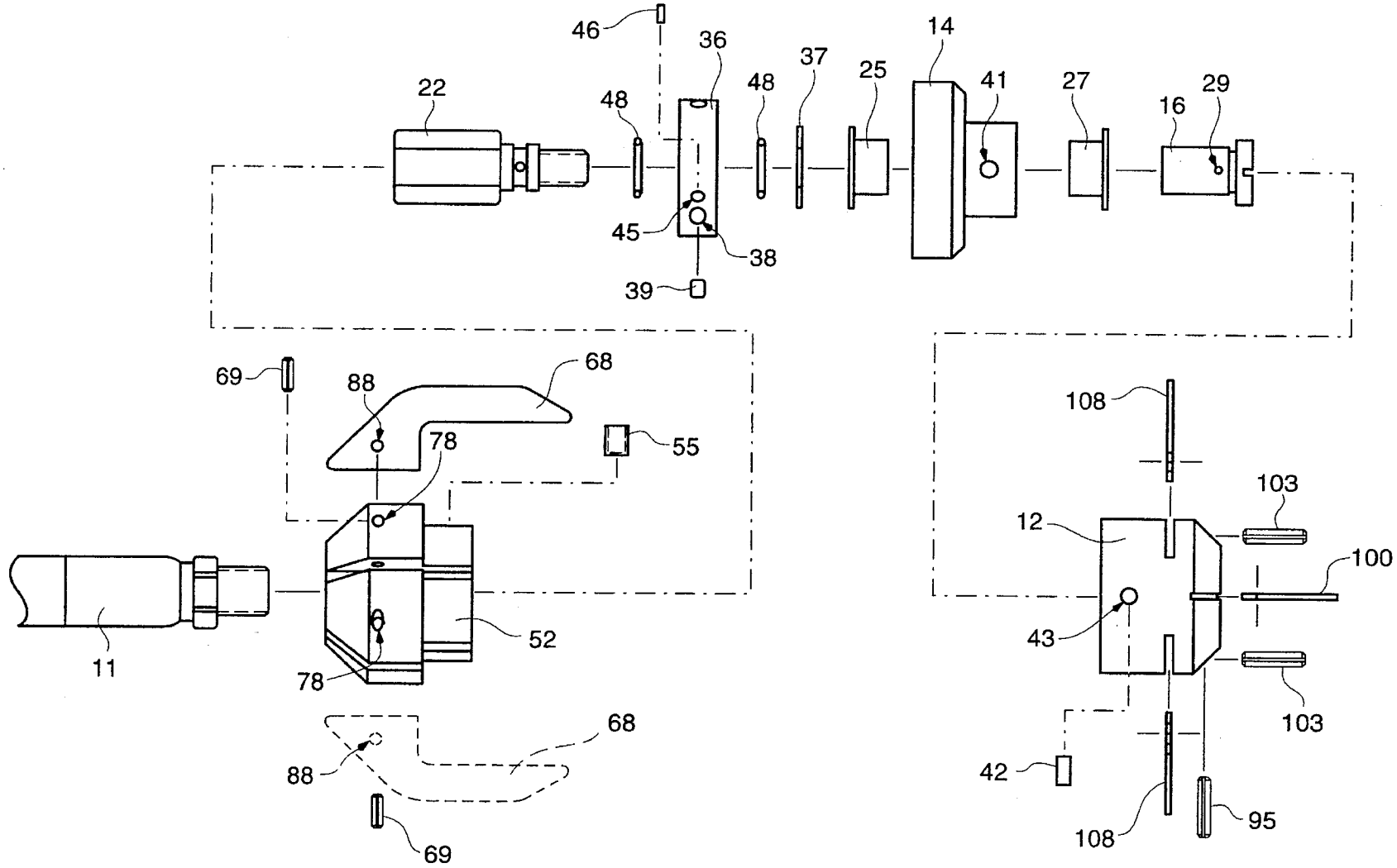
FIG. 3 is an exploded view of the embodiment of the present invention shown in FIG. 1B.
Figure 4A:
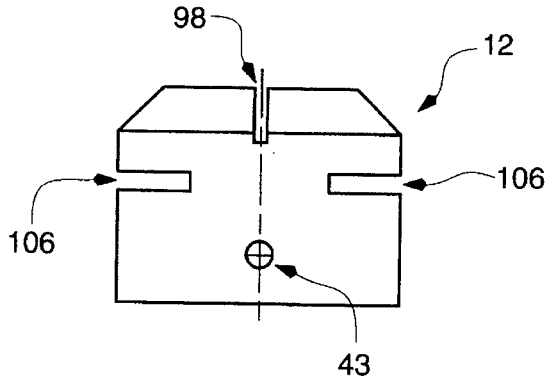
FIG. 4A is a front elevational view of a spinner cap of the present invention.
Figure 4B:
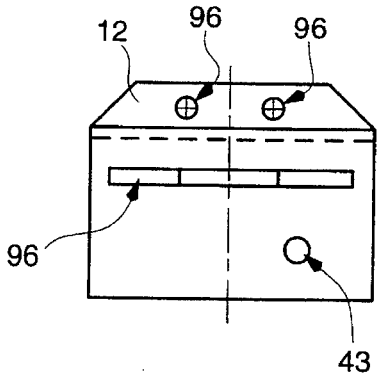
FIG. 4B is a right side view of the spinner cap of FIG. 4A.
Figure 4C:
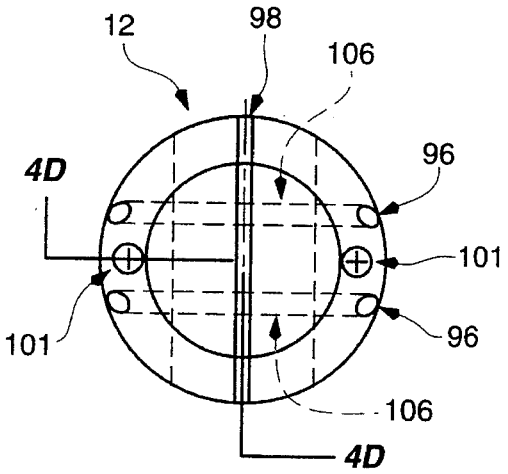
FIG. 4C is a top view of the spinner cap of FIG. 4A.
Figure 4D:
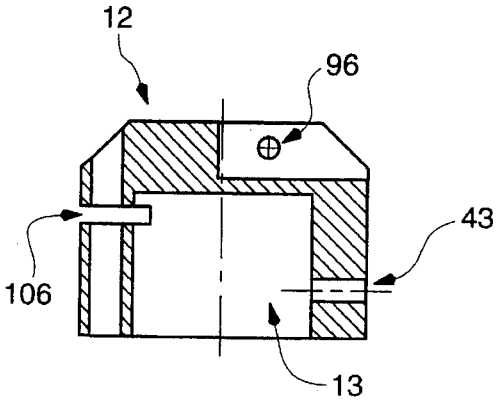
FIG. 4D is a cross sectional view of the spinner cap of FIG. 4C taken along reference line 4D—4D of FIG. 4C.

Referring now to FIGS. 1–3, the improved drain line cleaning apparatus of the present invention is generally identified as 10 and is threaded onto the end of high pressure hose 11, which generally carries water at a pressure of from 1000 to 3000 pounds per square inch. The invention 10 employs a spinner cap 12, which is shown in detail in FIG. 4A–D. Spinner cap 12 is generally domed-shaped and defines a bit slot 98 and two cutter slots 106. Preferably spinner cap 12 is made of anodized aluminum, however, other types of high strength materials may also be used, such as glass-filled plastic.

Bit 100, which is shown in detail in FIG. 11, is received in bit slot 98 and retained in place by two spring pins 95 which pass through spinner cap bores 96 and bit holes 97. Bit 100 is preferably generally triangular in shape in order to bore through debris when it is rotated by spinner cap 12. However, although other shapes may also be employed, including half-moon shapes, helixes and rectangles to achieve the intended result. Preferably bit 100 is made of hardened spring steel, however, other types of high-strength materials may also be used.

Cutter blades 108 are received in cutter slots 106 and are rotatably secured in place by spring pins 103 which pass through bores 101 and corresponding cutter blade holes. Cutter blades 108 are flail type cutters which pivot at their attachment point and are adapted to cut debris as spinner cap 12 rotates. The pivot of the flail allows a greater cutting radius at normal operating RPM and will fold back if a rigid blockage is encountered. Preferably, each cutter blade 108 has at least one sharpened edge on the edge of the blade that leads the revolution of the blade. In this way the sharpened edge will engage debris at high speed. Both sides of the cutter blade 108 may also be sharpened or neither side may be sharpened. Preferably cutter blades 108 are made of hardened spring steel; however other types of high strength materials may also be used. In addition, cutter blades 108 may be replaced by chains or plastic string or other materials that will cut debris when revolved at high speed.

Spin head 14 and shaft 16 are received by bore 13 of spinner cap 12. As best shown in FIGS. 5A–D and 12, spin head 14 is a unitary structure and includes small cylinder 15 which expands to form large cylinder 17. Preferably spin head 14 is made of anodized aluminum, however, other types of high strength materials may also be used, such as glass-filled plastics. A plurality of indents, preferably three, are spaced about the periphery of cylinder 15 and receive screws 42 which are screwed into threaded holes 43 of spinner cap 12. Screws 42 fixedly attach spin head 14 to spinner cap 12.

Figure 5A:
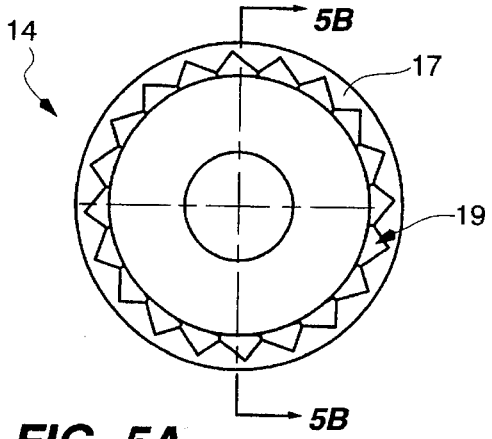
FIG. 5A is an elevational view of a spin head of the present invention.
Figure 5B:
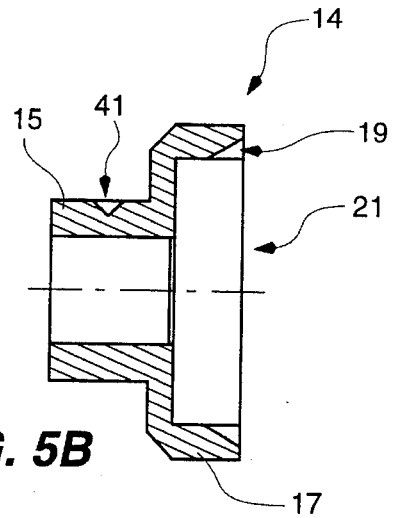
FIG. 5B is a cross sectional view of the spin head of FIG. 5A taken along line 5B—5B of FIG. 5A.
Figure 5C:
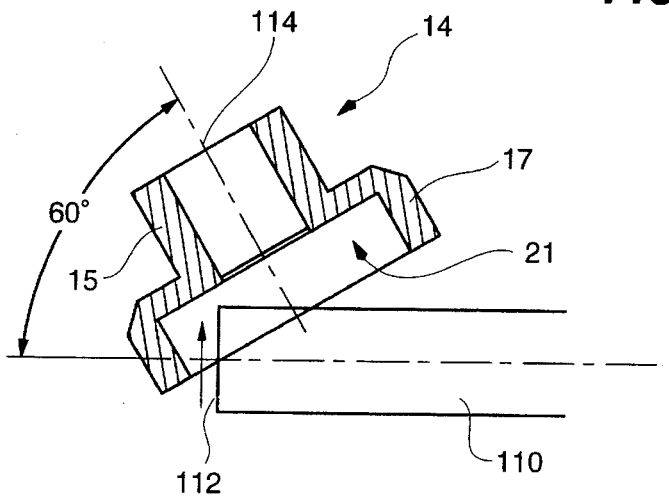
FIGS. 5C and 5D illustrate the formation of notches in the spin head of FIG. 5A.
Figure 5D:
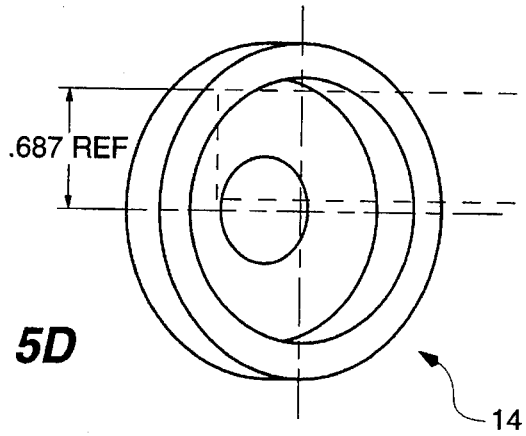

Large cylinder 17 defines a plurality of notches 19, preferably 20, about the internal surface of its open end 21. The notches 19 are formed at an angle such that a stream of water from a jet passageway (to be described below) will act to rotate the spin head 14 and will be deflected in a direction out and away from open end 21 of large cylinder 17. Ideally, the stream of water will be diverted along an axis generally parallel to the center line of large cylinder 17. Notches 19 may be made by machining or molding. In one embodiment, as shown in FIGS. 5C and 5D, notches 19 are made by milling tool 110 to create a notch having two surfaces which form a 90 degree angle. The notch surface formed by the end 112 of milling tool 110 defines a plane. An axis normal to that plane intersects the spin head axis 114 of spin head 14 and forms an angle of 60 degrees with respect to the spin axis 114. As shown in FIG. 10, one surface of each notch 19 captures the primary force of the stream of water from the jet passageways 38 and deflects it while reacting from the force to impart spin to spin head 14. This surface intersects the vector of the water stream at a preferred acute angle of approximately 60 degrees such that the water stream is deflected to opening 21 of spin head 14.

It should be understood that the two surfaces of each notch 19 may form an angle between approximately 60 degrees and approximately 120 degrees and the angle formed by an axis normal to the plane defined above and the spin axis 114 of the spin head 14 may be an angle between approximately 30 degrees and 90 degrees. As those of ordinary skill in the art will understand, the angle of the notches 19 and the angle at which they are oriented may be varied to vary the efficiency of using the water stream from passageways 38 to impart spin to spin head 14 and to generate forward thrust to the device 10. In this way the speed of rotation of spin head 14 and the forward thrust imparted to device 10 may be controlled.

As shown in FIGS. 1A and 2, bearing 18 is received by small cylinder 15 and defines a cylinder which receives shaft 16. Bearing 18 allows spin head 14 to freely rotate about shaft 16. In the embodiment shown in FIGS. 1 and 2, bearing 18 may be a flange bearing sold by IGUS Inc. of East Providence, R.I. under part number TFI-0809-12. In the embodiment shown in FIGS. 1B and 3, bearing 18 is replaced by bearings 25, 27. Bearings 25, 27 may be flange bearings sold by IGUS Inc. under part number TFI-0809-06.

Figure 6A:
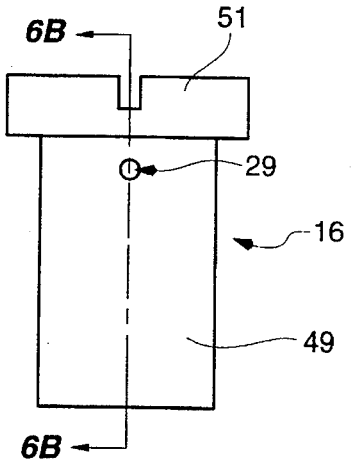
FIG. 6A is a front elevational view of a shaft of the present invention.
Figure 6B:
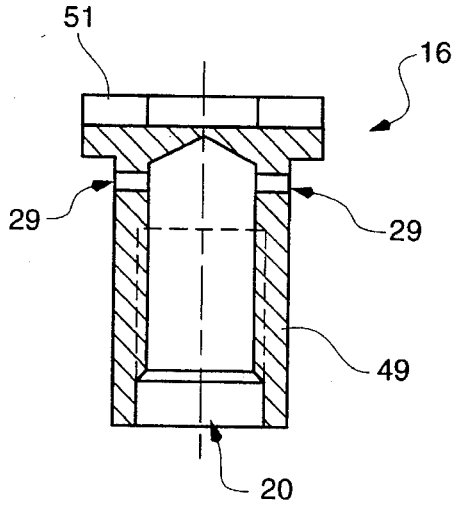
FIG. 6B is a cross sectional view of the shaft of FIG. 5A taken along line 6B—6B of FIG. 6A.

As best shown in FIGS. 6A–B, shaft 16 includes cylinder 49 and head 51. Cylinder 49 defines threaded bore 20. Holes 29 are located about cylinder 49. Holes 29 are adapted to allow water to pass therethrough to cool and lubricate bearing 18 or bearings 25, 27. In one embodiment, holes 29 are located opposite each other; however holes 29 may be located at other positions about the cylinder 49 and more or less than 2 holes may be used. Preferably, shaft 16 is made of hardened corrosion resistant steel; however, other types of high strength material may be used.

Figure 7A:
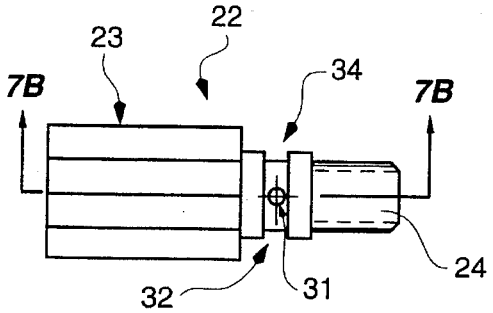
FIG. 7A is a front elevational view of a stem of the present invention.
Figure 7B:
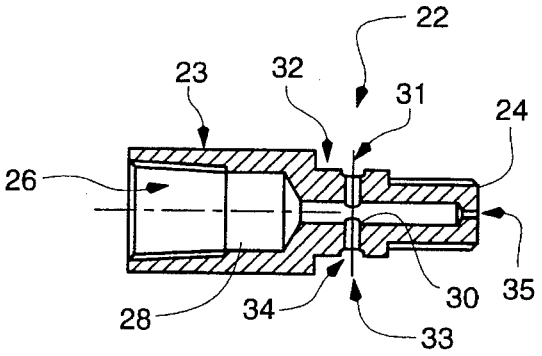
FIG. 7B is a cross sectional view of the stem of FIG. 7A taken along line 7B—7B of FIG. 7A.
Figure 7C:
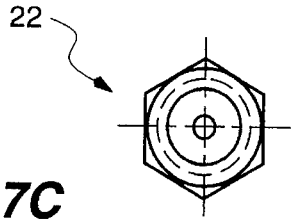
FIG. 7C is a left side view of the stem of FIG. 7A.

As best shown in FIGS. 7A–C, stem 22 includes threaded shaft 24 which is screwed into threaded bore 20 of shaft 16. Hexagonal stem portion 23 defines a threaded bore 26 which is adapted to receive the threaded end of high pressure hose 11. Intermediate stem portion 32 defines circumferential slot 34. Non-threaded bore 28 tapers into a cross-shaped passageway 30 which defines openings 31, 33 on the periphery of intermediate stem portion 32, within slot 34. Passageway 30 extends to the end of threaded shaft 24 where it narrows to form opening 35. Opening 35 is adapted to allow water to flow therethrough into shaft 16 and through holes 29. Preferably, stem 22 is made of corrosion resistant steel; however, other types of high strength materials can also be used.

Manifold 36 is positioned about intermediate stem portion 32, between hexagonal stem portion 23 and washer 37 which lies adjacent bearing 18. In addition, manifold 36 is received by large cylinder 17 of spin head 14.

Figure 8A:
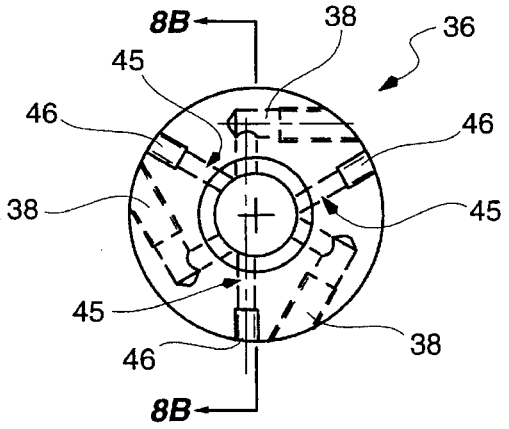
FIG. 8A is a top elevational view of a manifold of the present invention.
Figure 8B:
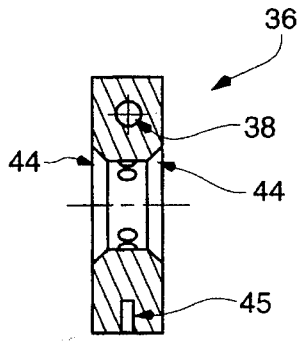
FIG. 8B is a cross sectional view of the manifold of FIG. 8A taken along line 8B—8B of FIG. 8A.
Figure 8C:
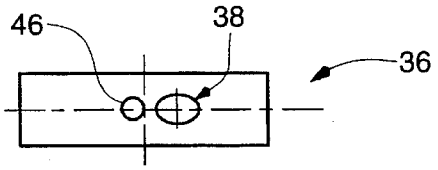
FIG. 8C is a front elevational view of the manifold of FIG. 8A.
Figure 9A:
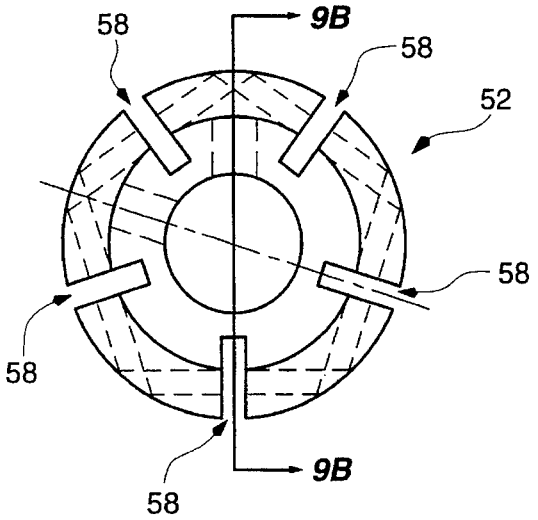
FIG. 9A is a top elevational view of a hub of the present invention.
Figure 9B:
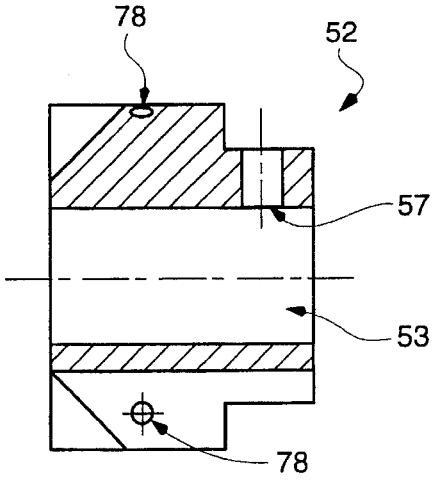
FIG. 9B is a cross sectional view of the hub of FIG. 9A taken along line 9B—9B.

As best shown in FIGS. 8A–C, manifold 36 defines three jet passageways 38 equally spaced about the periphery of manifold 36. Although three jet passageways 38 are shown, fewer or more jet passageways could be used. Preferably jet passageways 38 are L-shaped. As best shown in FIG. 10, nozzles 39 are threaded into the exits of jet passageways 38. Each nozzle 39 defines a bore 40 along its entire length, which acts to concentrate the force of the water passing therethrough. In one embodiment, nozzles 39 are each 0.25 inches long and each bore 40 is 0.0292 inches wide. It should be understood that each bore 40 may be of a size from approximately 0.0200 inches wide to approximately 0.093 inches wide. The size of bore 40 may be varied to allow proper operation depending on the water flow and pressure, as determined by the capacity of the high-pressure water supply to which the invention 10 is attached via hose 11.

The proximity of the L-shaped leg of passageway 38 to the periphery of manifold 36 requires that the cross hole portion of passageway 38 be drilled from the opposite side of the manifold. This forms bores 45, which are threaded to receive set screws 46 which plug bores 45.

The center of manifold 36 defines tapers 44 which are adapted to receive O-rings 48, respectively. Preferably O-rings 48 are made of nitrile (BUNA-N), duro 70. In one embodiment, O-rings sold by Parker Seal Group, O-Ring Division, of Lexington, Ky. under Parker No. 2-014 have been used. Manifold 36 and O-rings 48 seal slot 34 so that water entering slot 34 from openings 31, 33 will be forced to exit slot 34 via jet passageways 38. Preferably manifold 36 is made of anodized aluminum; however, other types of high strength materials may also be used, such as glass-filled plastics.

Hub 52 receives hexagonal stem portion 23 in bore 53 and abuts manifold 36. Hexagonal stem portion 23 is retained within bore 53 by one or more screws 55, which are screwed into corresponding threaded hole or holes 57. Hub 52 also defines multiple guiderail slots 58 for receipt of guiderails 68. Bores 78 are aligned with corresponding guiderail holes 88 and spring pins 69 are adapted to pass through the guiderail holes 88 and bores 78 to retain guiderails 68 in slots 58. Guiderails 68 act to guide the invention 10 along a drain line during operation. In one embodiment, five guiderails 68 are spaced equidistantly about hub 52.

Turning now to the operation of the drain line cleaning apparatus 10, a high pressure hose 11 is attached to stem 22 to introduce high pressure water into the apparatus 10 via the threaded bore 26 of stem 22. The cleaning apparatus 10/hose 11 combination is fed into a drain line. When high pressure water flows through hose 11, it is carried to cross-shaped passageway 30 where it is expelled through openings 31, 33 into slot 34, where the water is further forced into jet passageways 38 where the pressure of the water is concentrated via nozzles 39 and expelled from jet passageways 38. The expelled water exits the jet passageways 38 at high pressure, approximately 1000 to 3000 pounds per square inch. The expelled water impacts notches 19, thus forcing spin head 14 to rotate at high speed, approximately 14,000 to 15,000 RPM. Because spin head 14 is fixedly attached to spinner cap 12, spinner cap 12 also rotates at high speed, resulting in bit 100 rotating at high speed which allows it to bore through any debris. In addition, at such high speed, cutter blades 108 are extended by means of centrifugal force and will cut debris in its rotational path.

Due to the configuration of notches 19, high pressure water that impacts the notches is deflected approximately longitudinally away from bit 100. This creates a thrust that tends to force the root cutter in the direction generally shown by arrow 120 in FIGS. 1A and 1B. The high pressure water supplied by hose 11 may also be pulsed to pulse the resultant thrust.

In addition to passing through openings 31, 33, high pressure water also passes through the cross-shaped passageway 30 to the end of the threaded shaft 24 of stem 22. The water exits this passageway at opening 35 into shaft 16, where it will eventually pass through holes 29. As explained previously, the water passing through holes 29 acts to cool and lubricate bearing 18.

While various forms and modifications have been described above and illustrated in the drawings, it will be appreciated that the invention is not limited thereto but encompasses all variations and expedients within the scope of the following claims.

What is claimed is:

1. A drain line cleaning apparatus comprising:

a spin head adapted to rotate about a spin head axis; said spin head defining a cylinder; said cylinder further defining an internal surface having one or more notches each having a first surface and a second surface, said first surface forming a first angle with respect to said second surface;

said first surface of said one or more notches defining an axis perpendicular to said first surface, said axis of said first surface forming a second angle with respect to said spin head axis;

a generally cylindrical insert received at least partially within said spin head;

cutting means attached to said spin head and adapted to revolve about said axis when said spin head rotates;

means for providing pressurized water to said one or more notches of said spin head, whereby said spin head rotates when said one or more notches are impacted by pressurized water;

said pressurized water providing means including at least one jet passageway defined by said insert along a radial plane of said insert, said radial plane being perpendicular to said spin head axis;

wherein said pressurized water is directed by said at least one jet passageway to said first surface of said notch; and wherein said first surface of said one or more notches deflects said pressurized water along a path away from said spin head to generate thrust to propel said drain line cleaning apparatus.

2. The drain line cleaning apparatus of claim 1 further including a spinner cap attached to said spin head, wherein said cutting means is rotatably attached to said spinner cap.

3. The drain line cleaning apparatus of claim 2 further including a nozzle located within said at least one jet passageway.

4. The drain line cleaning apparatus of claim 3 further including a bit attached to said spinner cap.

5. The drain line cleaning apparatus of claim 4 further including bearing means for engagement with said spin head, whereby said spin head rotates about said bearing means.

6. The drain line cleaning apparatus of claim 5 further including cooling means for said bearing means.

7. The drain line cleaning apparatus of claim 6 further including lubricating means for said bearing means.

8. The drain line cleaning apparatus of claim 7 further including guiding means for guiding said apparatus through said drain line.

9. The drain line cleaning apparatus of claim 8 wherein said guiding means includes one or more guiderails.

* * * * *